United States Patent [19]

Flynn

[11] Patent Number: 4,846,514

[45] Date of Patent: Jul. 11, 1989

[54] DOOR LATCH APPARATUS

[76] Inventor: Jean L. Flynn, P.O. Box 1868, Deland, Fla. 32720

[21] Appl. No.: 149,505

[22] Filed: Jan. 28, 1988

[51] Int. Cl.[4] ..... E05C 17/04

[52] U.S. Cl. ..... 292/268; 292/272; 292/262

[58] Field of Search ..... 292/263, 268, 269, 270, 292/272, 273, 274, 276, 262

[56] References Cited

U.S. PATENT DOCUMENTS

| | | | |
|---|---|---|---|
| 222,338 | 12/1879 | Wittich | 292/269 |
| 355,419 | 1/1887 | Sprado | 292/268 |
| 687,348 | 11/1901 | Speirs | 292/269 |
| 726,645 | 4/1903 | Connor | 292/274 |
| 768,528 | 8/1904 | Kalb et al. | 292/273 |
| 984,612 | 2/1911 | Spangler | 292/269 |
| 1,388,712 | 8/1921 | Hoffman | 292/269 |
| 1,524,088 | 1/1925 | Ernst | 292/269 |
| 1,596,183 | 8/1926 | Horlick, Jr. | 292/268 |
| 2,030,916 | 2/1936 | Gard | 292/269 |
| 2,505,320 | 4/1950 | Bernhard | 292/269 |
| 2,919,945 | 1/1960 | Tannen | 292/262 |
| 4,017,104 | 4/1977 | Walker | 292/268 |
| 4,062,578 | 12/1977 | Chen | 292/269 |

FOREIGN PATENT DOCUMENTS

| | | | |
|---|---|---|---|
| 13159 | 3/1903 | Austria | 292/268 |
| 223108 | 10/1924 | United Kingdom | 292/271 |
| 2068451 | 8/1981 | United Kingdom | 292/268 |
| 2173246 | 10/1986 | United Kingdom | 292/270 |

*Primary Examiner*—Gary L. Smith
*Assistant Examiner*—Eric K. Nicholson
*Attorney, Agent, or Firm*—William M. Hobby, III

[57] ABSTRACT

A door latch apparatus has a door latch face plate adapted to be attached to a doors edge and a door latch bolt adjustably fastened to the door face plate and having a latch head on one end thereof protruding from the door latch face plate. A door jamb bracket has a latch head track formed therein for receiving the door latch bolt latch head therein when the door is closed. A latching member is hinged to the door jamb bracket and has a latch head track formed therein. The latching member has an unlatched position swung out of the path of the latch bolt latch head protruding from the door and a latched position aligning the position of the latched member latch head track with the door jamb bracket latch head track so that the latch bolt head will slide from the door jamb bracket latching head track into the latching member latching head track when the latch member has been placed in a latched position while the door is closed.

7 Claims, 1 Drawing Sheet

DOOR LATCH APPARATUS

BACKGROUND OF THE INVENTION

The present invention relates to door latches and especially to a door latch which allows a door to be partially opened while latched.

In the past a wide variety of door locks have been provided for various types of doors. A typical door lock has a locking cylinder mounted through a door which may be operated with a key for sliding a dead bolt or latching bolt from the door into a face plate mounted on the door jamb. This type of latch may also have a separate door knob or may have the cylinder mounted in the door knob. Other types of locks include mortise locks and various types of locks for sliding glass doors and windows. One common type of lock commonly found in motel and hotels is a chain lock door bolt which has a door plate which is attached with screws to the inside of the door. The door plate has a slot with an enlarged opening at one end while the jamb has a jamb plate attached thereto with screws, A chain is fixedly attached to the same plate. The chain has a slide bolt on one end which can be placed in the enlarged opening of the slot and slid into the slot of the door plate to allow the door to be partially opened while maintaining the door in a locked position. Typically this type of prior art chain lock has a retainer opening in the jamb plate for holding the slide bolt when the chain lock is disconnected. A second type of lock which works similar to a chain lock for allowing a door to be partially opened includes an arcuate hinged latching member shaped like an elongated "U" which allows a locking bolt to fit therein to allow the door to slide to the end of the elongated arcuate "U". The principal disadvantage of both of these prior art type chain locks is that the screws are generally mounted on the inside of the door and jamb so that the doors can be kicked open, breaking the jamb plate or the door plate away from the door jamb and allowing an intruder to enter through the door. The present invention is aimed at a more secure locking system for allowing the door to be partially open while remaining latched and which has a more aesthetic appearance.

SUMMARY OF THE INVENTION

A door latch apparatus is provided with a door latch face plate adapted to be attached to a door edge and a door latch bolt adjustably fastened to the door face plate and having a latch head on one end thereof protruding from the door latch face plate. A door jamb bracket has a latch head track formed therein for receiving the door latch bolt latch head therein when a door is closed. A latching member is hinged to the door jamb bracket and has a latch head track formed therein. The latching member has an unlatched position swung out of the path of the latch bolt latch head protruding from the door and a latched position aligning the position of the latching member latch head track with the door jamb bracket latch head track so that the latch bolt head will slide from the door jamb bracket latching head track into the latching member latching head track when the latching member has been placed in a latched position while the door is closed. The latching member latch head track is open at one end for aligning with the door jamb bracket latch head track and is closed at the other end to block the escape of the latch bolt latch head. The door jamb bracket latch head track is open at one end for aligning with the latching member latch head track and is closed at the other end. The latching member is hinged to the door jamb bracket with a hinge pin and is spring loaded to hold the latching member in a latched position or in an unlatched position. The door latch face plate has a cylinder with a threaded bore therethrough fixedly attached thereto. The latch bolt has a partially threaded shaft threadedly attached through the face plate and cylinder through the threaded bore in the cylinder. The door latch face plate cylinder has the latch bolt partially threaded shaft threaded therethrough and locked in position with a lock nut to adjust the door latch head so that the latch bolt can be threaded into or out of the face plate to adjust the latch bolt head relative to the face plate. The tracks on both the door jamb bracket and the latching member are sized to allow the latch bolt latch head to fit loosely therein to thereby allow the door bolt latch head to slide in the tracks without wedging therein as the door is swung partially open.

BRIEF DESCRIPTION OF THE DRAWINGS

Other objects, features and advantages of the present invention will be apparent from the written description and the drawings in which.

DESCRIPTION OF THE PREFERRED EMBODIMENT

Figures 1, 2, 3, 4, 5, 6, 7:
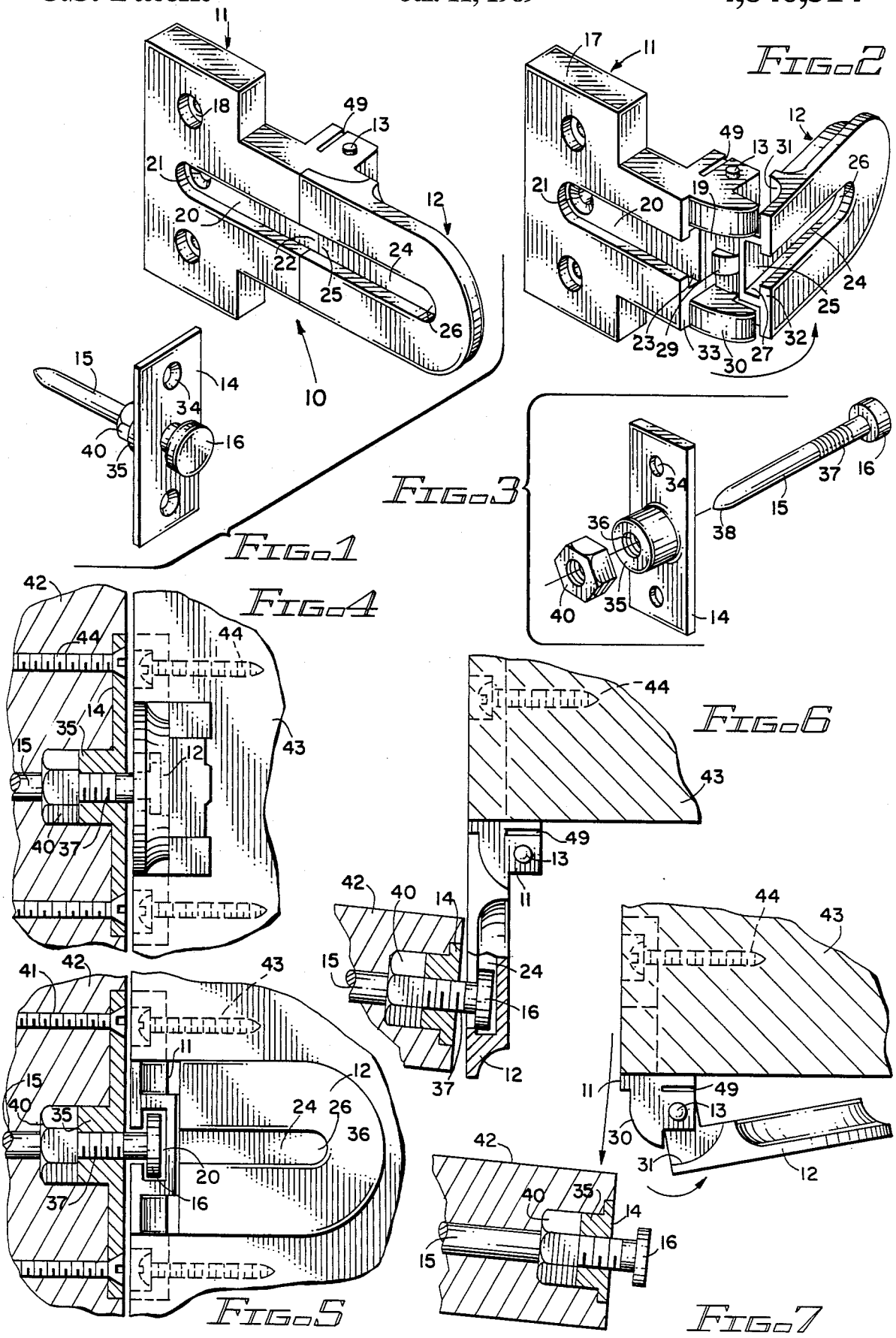
FIG. 1 is an exploded view of a door latch apparatus in accordance with the present invention.
FIG. 2 is a perspective view of a door jamb bracket in accordance with claim 1 having the latching member in an unlatched position.
FIG. 3 is an exploded perspective view of the door bolt and face plate of FIG. 1.
FIG. 4 is a sectional view of a door latching apparatus in accordance with the present invention mounted in a door and door jamb in a latched position.
FIG. 5 is a sectional view in accordance with FIG. 4 in an unlatched position.
FIG. 6 is a top sectional view of a door latch in accordance with FIGS. 1 through 5 in a latched position.
FIG. 7 is a sectional view of the door latch in accordance with FIG. 6 in an open position.

Referring to the drawings, FIG. 1 through 7, a door latch mechanism 10 has a jamb bracket 11 with a latching member 12 hinged thereto with a hinge pin 13. A door face plate 14 has a latch bolt 15 having a latching head 16 on one end thereof with the latch bolt extending through the face plate 14. The door jamb bracket 11 is formed of a plate 17 having counter sunk screw holes 18 and a track 20 extending therein closed at one end 21 and open at the other end 22 thereof. The track 20 has recessed track grooves 23 formed on either side thereof for holding the door bolt 15 head 16 therein. The latching member 12 also has a track 24 therein open at one end 25 and closed at the other end 26 and having a pair of recessed grooves 27 formed therein for holding the bolt head 16. The track 24 and the track 20 exactly align with each other at their open ends 23 and 25 when the hinge latching member 12 is swung into a latching position as shown in FIG. 1. The jamb bracket 11 has an arcuate surface 30 which aligns with an arcuate surface 31 on the latching member 12 so that when the latching member 12 is rotated on the hinge pin 13, it swings around until the abutting edge 32 abuts the abutting edge 33 of the jamb bracket 11.

Face plate 14 has a pair of counter sunk screw holes 34 therein and has a cylinder 35 fixedly attached thereto with a threaded bore 36 passing therethrough and through the face plate 14. The latch bolt 15 is partially threaded at 37 and has a pointed end 38. The bolt 15 is slid through an opening in the face plate and through the cylinder 35 until the external threads 37 engage the internal threads 36 and is threaded thereinto to position the latch head latch bolt 16 properly to align up with the track 20 of the jamb bracket 11. Once properly positioned, the lock nut 40 is threaded onto the end of the threaded portion 37 of the lock bolt 15 to lock the bolt in place. The face plate 14 is mounted in the door as shown in FIGS. 4, 5, 6 and 7 with screws 41 passing through the openings 34 into a door 42 while the jamb bracket 11 is attached to the door jamb 43 with screws 44 passing through the openings 18. The jamb and door are drilled and cut out to except the door latch mechanism. A leaf spring 19 as seen in FIG. 2 is mounted in a pair of slots 49 in the jamb bracket 11 and is pushed against by camming surface 29 on the latching member 12 when the latching member is in a locked position. This gives the door latch a snap action and maintains the latch in either an open or closed position.

In operation once the door jamb bracket 11 is attached to a door and the door bolt 15 and the face plate 14 are attached to the door, the door can be closed when the door jamb bracket is positioned as shown if FIGS. 2 and 7 allowing the adjusted bolt head 11 to slide into the track 20 to hold a bolt head into the grooves 23. The door can be opened and closed at will until the latching member 11 is swung from the position shown in FIGS. 2, 5 and 7 to the position shown in FIGS. 1, 4 and 6 with the tracks 20 and 24 aligned and abutting each other with the abutting edges 32 and 33 to form one continuous track with a closed end 26. Opening a closed door will allow the head 16 to slide into the track 20 and then into the track 24 until it reaches the end 26 where it is stopped. The enlarged track is shown in FIG. 5 and 6 and allows the bolt head 16 to slide therein without wedging as the door makes a slight arc as the door is swung ajar. Thus, once the door is closed with the door latching mechanism attached, the latching member 12 can be swung into the locked position to provide a security lock which will allow the door to be partially opened. To unlock the door merely requires swinging the hinged latching member 12 on the pin 13 out of the way of the lock bolt 15 head 16 which then slides out the end 23 of the track 20. The latching member 12 is spring loaded by spring 19 and cam 29 to allow it to snap out of place and held in position, and then to be snapped into place with the face plate 14. The bolt 15 is securely attached to the door with long screws 41 and with the cylinder 35 and the elongated bolt 15 extending well into the door while the bracket is attached to the jamb in a cutout and can have longer screws and can thus resist greater force than from a typical chain lock. In addition, the force is a shearing force from the side of the screws rather than a direct force applied towards yanking the screws out of the jamb.

It should be clear at this point that a door latching mechanism has been provided which is aesthetically appealing and provides substantially greater strength than commonly used door latching mechanisms which allow a door to be partially open while remaining latched. However, the present invention is not to be construed as limited to the form shown which is to be considered illustrative rather that restrictive.

I claim:

1. A door latch apparatus comprising:

a door latch face plate adapted to be attached to a door edge and having a threaded bore therethrough;

a door latch bolt having a threaded portion and adjustably fastened to said door face plate through said threaded bore and having an enlarged latch head on one end thereof protruding from said door latch face plate;

a door jamb bracket having a latch head track formed therein for receiving said door latch bolt latch head therein when said door is closed, said door jamb bracket latch head track having a pair of elongated recessed grooves to capture said enlarged latch head of said door latch bolt therein; and a latching member hinged to said door jamb bracket also and having a latch head track formed therein, said latching member latch head track having a pair of elongated recessed grooves therein, said latching member having an unlatched position swung out of the path of said latch bolt latch head protruding from said door and a latched position aligning the position of the latching member latch head track with the door jamb racket latch head track whereby said latch bolt head will slide from said door jamb bracket latch head track into said latching member latch head track when said latching member has been placed in latched position upon opening the door and will hold said door latch bolt enlarged latch head in said latching member head track in said pair of recessed grooves.

2. A door latch apparatus in accordance with claim 1 in which said latching member latch head track is open at one end for aligning with said door jamb bracket latch head track and is closed at other end to block the escape of said latch bolt latch head.

3. A door latch apparatus in accordance with claim 2 in which said door jamb bracket latch head track is open at one end for aligning with said latching member latch head track and is closed at other end.

4. A door latch apparatus in accordance with claim 3 in which said latching member is hinged to said door jamb bracket with a hinge pin and is spring loaded to hold said latching member in a latched position or an unlatched position.

5. A door latch apparatus in accordance with claim 4 in which said door latch face plate has a cylinder fixedly attached thereto and having said door latch face plate threaded bore extending therethrough, and said latch bolt has a partially threaded shaft and is threadedly attached to said face plate and cylinder through said bore through said face plate and cylinder.

6. A door latch apparatus in accordance with claim 5 in which said door latch face plate cylinder has said latch bolt partially threaded shaft attached therethrough and locked in position with a lock nut to adjust said door latch head, whereby said latch bolt can be threaded into or out of said face plate to adjust said latch bolt head relative to said face plate and then locked in the adjusted position.

7. A door latch apparatus in accordance with claim 6 in which said door jamb bracket latch head track recessed grooves and said latching member latch head track recessed grooves are sized to allow said latch bolt latch head to fit loosely therein to thereby allow said door bolt latch head to slide in said tracks.

* * * * *